United States Patent [19]

Seja et al.

[11] Patent Number: 4,971,081

[45] Date of Patent: Nov. 20, 1990

[54] HAIR CURLING ROD HAVING RETRACTABLE BRISTLES

[75] Inventors: Frank Seja, Darmstadt; Rupert Zang, Grossostheim, both of Fed. Rep. of Germany

[73] Assignee: Wella Aktiengesellschaft, Darmstadt, Fed. Rep. of Germany

[21] Appl. No.: 465,479

[22] Filed: Jan. 16, 1990

[30] Foreign Application Priority Data

Jan. 25, 1989 [DE] Fed. Rep. of Germany ..... 3902111

[51] Int. Cl.[5] ..... A45D 24/16

[52] U.S. Cl. ..... 132/121; 132/123; 132/119; 15/184

[58] Field of Search ..... 132/119, 121, 123, 226, 132/227, 228, 229, 245, 271, 272; 15/184, 185, 203

[56] References Cited

U.S. PATENT DOCUMENTS

| | | | |
|---|---|---|---|
| 3,108,305 | 10/1963 | Peilet | 132/119 |
| 3,110,053 | 11/1963 | Sorabian | 132/119 |
| 3,990,460 | 11/1976 | Shalvoy | 132/229 |
| 4,023,578 | 5/1977 | Buhler | 132/271 |
| 4,028,768 | 6/1977 | Pascal | 132/119 |
| 4,473,086 | 9/1984 | Thaler et al. | 132/229 |

FOREIGN PATENT DOCUMENTS

| | | | |
|---|---|---|---|
| 577811 | 7/1976 | Switzerland | 132/245 |

*Primary Examiner*—John J. Wilson
*Assistant Examiner*—Frank A. Laviola, Jr.
*Attorney, Agent, or Firm*—Michael J. Striker

[57] ABSTRACT

In a hair curling rod having retractable bristles passing through apertures in a cylindrical body for winding up the hair and a device for directing a stream of heated air through the outlet apertures, the bristles or prongs are retractable independency on the temperature of the heated air stream. Preferably, the bristles are secured at one thereof to a movable support controlled by a temperature dependent element of a shape-memory alloy situated in the stream of heated air to expand or contract in response to predetermined temperatures.

11 Claims, 1 Drawing Sheet

HAIR CURLING ROD HAVING RETRACTABLE BRISTLES

BACKGROUND OF THE INVENTION

The present invention relates to a hair curler provided with retractable bristles or prongs, wherein a stream of heated air is blowing through outlet openings in a cylindrical winding body.

In known hair curlers combined with hair drying the so-called air-curl apparatuses—the retractable bristles or prongs are employed in order to enable the removal of the curl in its shaped condition from the winding body and then to condition the curl in the ambient air. The retraction of the bristles or prongs is effected by means of control elements which are arranged either in the handle of the curler or at the tip of the winding body. This prior art arrangement requires additional handles or additional attention on the side of the hair styler.

SUMMARY OF THE INVENTION

An object of the present invention is to provide an improved hair curler of the above described kind wherein the bristles or prongs retract automatically.

According to the invention this object is achieved by the provision of means which retract the bristles or prongs in dependency on the temperature of the heated air stream.

In a preferred embodiment, the temperature dependent means for retracting the bristles or prongs includes a temperature sensitive element of a shape memorizing or shape memory alloy.

The invention has the advantage that the bristles or prongs are retracted without any operating process when the hairs are wound upon the turning roller body. The invention is based on the recognition that due to the winding up of the hairs on the perforated curling body the flow resistance in the range of the air outlet openings is increased. As a consequence, the air stream is reduced thus causing at a given heating power a temperature increase in the air stream. When the air temperature reaches a predetermined value, then the bristles or prongs are automatically retracted by the heat sensitive element so that the curl can be removed from the winding curling body without any uncurling.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENT

Figure 1:
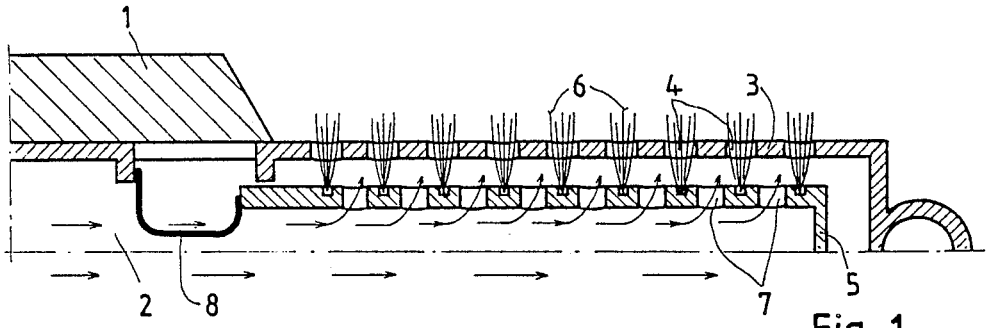
FIG. 1 shows a longitudinal section of a portion of the curling rod of the invention in a position with projecting bristles.

In the FIGURES like component parts are designated with the same reference numerals. For the sake of clarity only one half of the rotation-symmetrical curling roller body and the retracting device are illustrated. Also, the handgrip is illustrated only partially.

A heated air stream 2 generated by means of a non-illustrated blower and heater is fed through an inlet opening into a tubular curling body 3 provided in its jacket with a plurality of outlet apertures 4 through which the heated air exits. Within the curling body 3 is arranged an axially shiftable adjusting device 5 which serves simultaneously as an anchoring device for the bristles 6. The adjusting device 5 has also a tubular or cylindrical configuration and is provided on its jacket with outlet apertures 7 for the heated air.

The bristles 6 are arranged in clusters projecting respectively through the outlet openings 4 above the cylindrical surface of the curling body 3. The tubular adjusting device 5 is connected at one end thereof to the inner wall of the curling body 3 by means of a temperature sensitive element 8 which expands or retracts in response to the temperature changes of the air stream 2. The element 8 consists of shape renewable or memory alloys known for example from the German magazine "Zeitschrift für wirtschaftliche Fertigung" Volume 81, year 1986, copy 12, pages 703 to 708. Examples of such shape memory alloys described in the literature are NiTi, Cu-Zn-Al and Cu-Al-Ni. Different alloys of this kind are commercially available in a large number of shapes whereby the temperature at which the alloy changes its shape is selectable within broad limits.

In FIG. 1 the hair curler is illustrated in a position in which no hairs are wound on the tubular curling body 3 and the temperature of the air stream 2 is below that required for the expansion or contraction of the mounting element 8.

Figure 2:
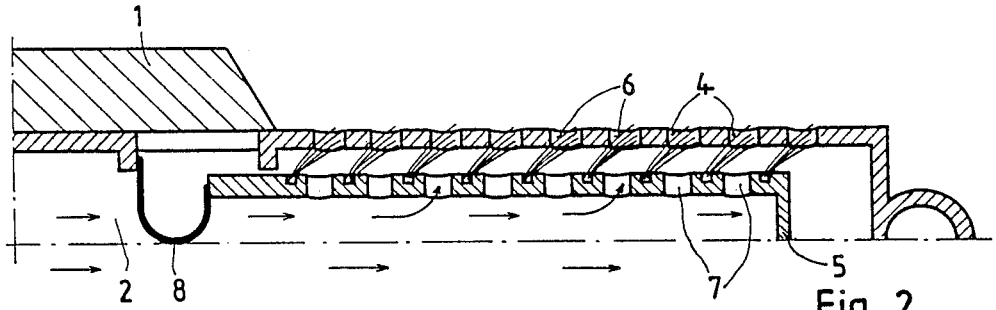
FIG. 2 shows the curling rod of FIG. 1 with retracted bristles.

In contrast, FIG. 2 illustrates the hair curler in a condition in which hairs (non-illustrated) have been wound on the tubular curling body 3, thus causing a temperature increase in the heated airstream 2 due to the localization of heat. As a result the temperature dependent element 8 has changed its shape or contracted in such a manner that the adjusting device 5 is shifted toward the hand gripper 1. In this actuated position the outlet apertures 4 are no longer opposite the anchoring points of respective clusters of bristles and, consequently, the bristles are retracted into the interior of the curling body 3. As soon as the tubular curling body is removed from the completed hair curl the heated air is free to exit and its temperature drops to a lower value at which the temperature sensitive mounting element 8 resumes its original shape and the adjusting device 5 is axially shifted into its initial position in which the clusters of bristles again project through the outlet aperture 4.

While the invention has been illustrated and described as embodied in a specific example, it is not intended to be limited to the details shown, since various modifications and structural changes may be made without departing in any way from the spirit of the present invention. For example, it is possible to employ different configurations and operational characteristics of the temperature sensitive mounting element 8 whereby a plurality of such mounting elements can h=employed. In addition, the retraction or protrusion of the clusters of bristles can also be controlled manually. Furthermore, among the different configurations of the temperature dependent mounting element it is of advantage to use the shape of a helical spring whose length changes with temperature. In another modification the hair curler of this invention can be provided with a rotary curling body.

Instead of the illustrated axial displacement of the anchoring device for the bristles, it is possible to use a rotatably supported adjusting and anchoring member. For example, when teeth or prongs are used instead of bristles, they can be anchored in a rotatably supported adjusting member. The rotary movement of the anchoring member can be affected directly by means of a corresponding temperature dependent element. For example, parts of an alloy having shape memory are available which have the form of an expanding spring. The helix of the expanding spring can be coaxially arranged in the tubular curling body whereby one end of the spring is fixed to the hand gripper housing and the other end is connected to the rotary anchoring member for the bristles or prongs. Nevertheless, for producing a rotary motion, linear temperature dependent elements are also applicable because their motion can be transformed into a rotary motion by appropriate measures for example by means of a connecting link guide.

What is claimed as new and desired to be protected by Letters Patent is set forth in the appended claims.

1. Hair curler having retractable bristles comprising a tubular curling body provided with an inlet for a stream of heated air and a plurality of outlet apertures for the air; said bristles being attached to a movable support located within the curling body to move between a position in which said bristles project through said outlet apertures and a position in which they are retracted, and means responsive to a change in temperature for moving said movable support between said positions whereby the bristles are moved between said positions in response to the heated air stream.

2. A hair curler as defined in claim 1, wherein said moving means includes at least one temperature dependent element arranged in said air stream and acting on said movable support.

3. A hair curler as defined in claim 2, wherein said temperature dependent element is secured between an inner wall of said tubular curling body and said movable support to move the moveable support relative to the curling body.

4. A hair curler as defined in claim 2, wherein said temperature dependent element is of a shape memory alloy which expands and contracts in response to the temperature of the air stream.

5. A hair curler as defined in claim 4, wherein said movable support is rotatably supported within said curling body.

6. A hair curler as defined in claim 5, wherein said temperature dependent element has the form of an expanding spring.

7. A hair curler as defined in claim 4, wherein said movable support is in the form of a tubular supporting member coaxially arranged within said tubular curling body to move between said projecting and retracting positions.

8. A hair curler as defined in claim 7, wherein said temperature dependent element has a U-shaped configuration connected at each and between an inner wall of said tubular curling body and said tubular support.

9. A hair curler as defined in claim 7, wherein said tubular support has outlet apertures for the heated air stream, said bristles being anchored between said outlet apertures in the tubular support, and said temperature dependent element contracting after said air stream has exceeded a predetermined temperature to retract said bristles in the outlet apertures.

10. A hair curler as defined in claim 7, wherein said temperature dependent element has a helical form.

11. A hair curler as defined in claim 1, further comprising means for manually retracting and projecting said bristles in the outlet apertures.

* * * * *